US011753880B2

(12) United States Patent
Oser et al.

(10) Patent No.: US 11,753,880 B2
(45) Date of Patent: Sep. 12, 2023

(54) WINCH OVERLOAD PROTECTION SYSTEM

(71) Applicant: Halliburton Energy Services, Inc., Houston, TX (US)

(72) Inventors: Michael Stephen Oser, Frisco, TX (US); Mickie James Theriot, Chauvin, LA (US); Robert Alexander Lyons, Jr., Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 737 days.

(21) Appl. No.: 16/063,766

(22) PCT Filed: Mar. 3, 2017

(86) PCT No.: PCT/US2017/020616

§ 371 (c)(1),
(2) Date: Jun. 19, 2018

(87) PCT Pub. No.: WO2018/160190

PCT Pub. Date: Sep. 7, 2018

(65) Prior Publication Data

US 2021/0164302 A1 Jun. 3, 2021

(51) Int. Cl.
*E21B 19/02* (2006.01)
*B66D 1/58* (2006.01)
*E21B 19/08* (2006.01)

(52) U.S. Cl.
CPC ..... *E21B 19/02* (2013.01); *B66D 1/58* (2013.01); *E21B 19/08* (2013.01)

(58) Field of Classification Search
CPC ..... E21B 19/008; E21B 19/02; E21B 19/08; B66D 1/58
See application file for complete search history.

(56) References Cited

U.S. PATENT DOCUMENTS

| | | | | |
|---|---|---|---|---|
| 1,779,581 | A * | 10/1930 | Behnke | E21B 19/08 254/270 |
| 3,035,712 | A | 5/1962 | Nowack | |
| 4,109,798 | A | 8/1978 | Comyns-Carr | |
| 4,787,524 | A | 11/1988 | Cobb, III et al. | |
| 7,033,504 | B1 | 4/2006 | Blytas et al. | |
| 2007/0017889 | A1 | 1/2007 | Schobesberger | |
| 2012/0292048 | A1 * | 11/2012 | Harrell | E21B 41/0021 166/85.1 |
| 2013/0255969 | A1 | 10/2013 | Olsen et al. | |
| 2015/0167446 | A1 | 6/2015 | Taskinen et al. | |

FOREIGN PATENT DOCUMENTS

| | | | | |
|---|---|---|---|---|
| DE | 4422927 | A1 * | 1/1996 | B66D 1/50 |
| GB | 2132972 | A | 7/1984 | |
| WO | 2005113930 | A1 | 12/2005 | |
| WO | 2016118714 | A1 | 7/2016 | |

* cited by examiner

*Primary Examiner* — Matthew R Buck

(74) *Attorney, Agent, or Firm* — Thomas Rooney; Parker Justiss, P.C.

(57) ABSTRACT

The present disclosure provides a winch overload protection system, a workover system, and a method for operating a workover system. The winch overload protection system, in one embodiment, includes an overload detection unit operable to detect when a load on a winch of a workover system exceeds a safety load limit. The winch overload protection system, in this embodiment, further includes an overload control unit configured to receive an overload signal from the overload detection unit, and in response thereto release a brake on the winch.

19 Claims, 2 Drawing Sheets

WINCH OVERLOAD PROTECTION SYSTEM

CROSS-REFERENCE TO RELATED APPLICATION

This application is the National Stage of, and therefore claims the benefit of, International Application No. PCT/US2017/020616 filed on Mar. 3, 2017, entitled "WINCH OVERLOAD PROTECTION SYSTEM". The above application is commonly assigned with this National Stage application and is incorporated herein by reference in its entirety.

BACKGROUND

Hydraulic Workover Units (HWOs) for use with oil/gas wells typically use one or more winches mounted on a mast (also called a "gin pole") attached to the unit for lifting pipe and other equipment. Frequently, the winch is connected via cable to the pipe or other downhole tools when the pipe or tools are made ready to insert into or remove from a well. Existing HWOs, and the components thereof, have generally been considered satisfactory for their intended purpose. However, there is still a need in the art for improvements thereto. The present disclosure provides a solution for this need.

BRIEF DESCRIPTION

Figure 1:
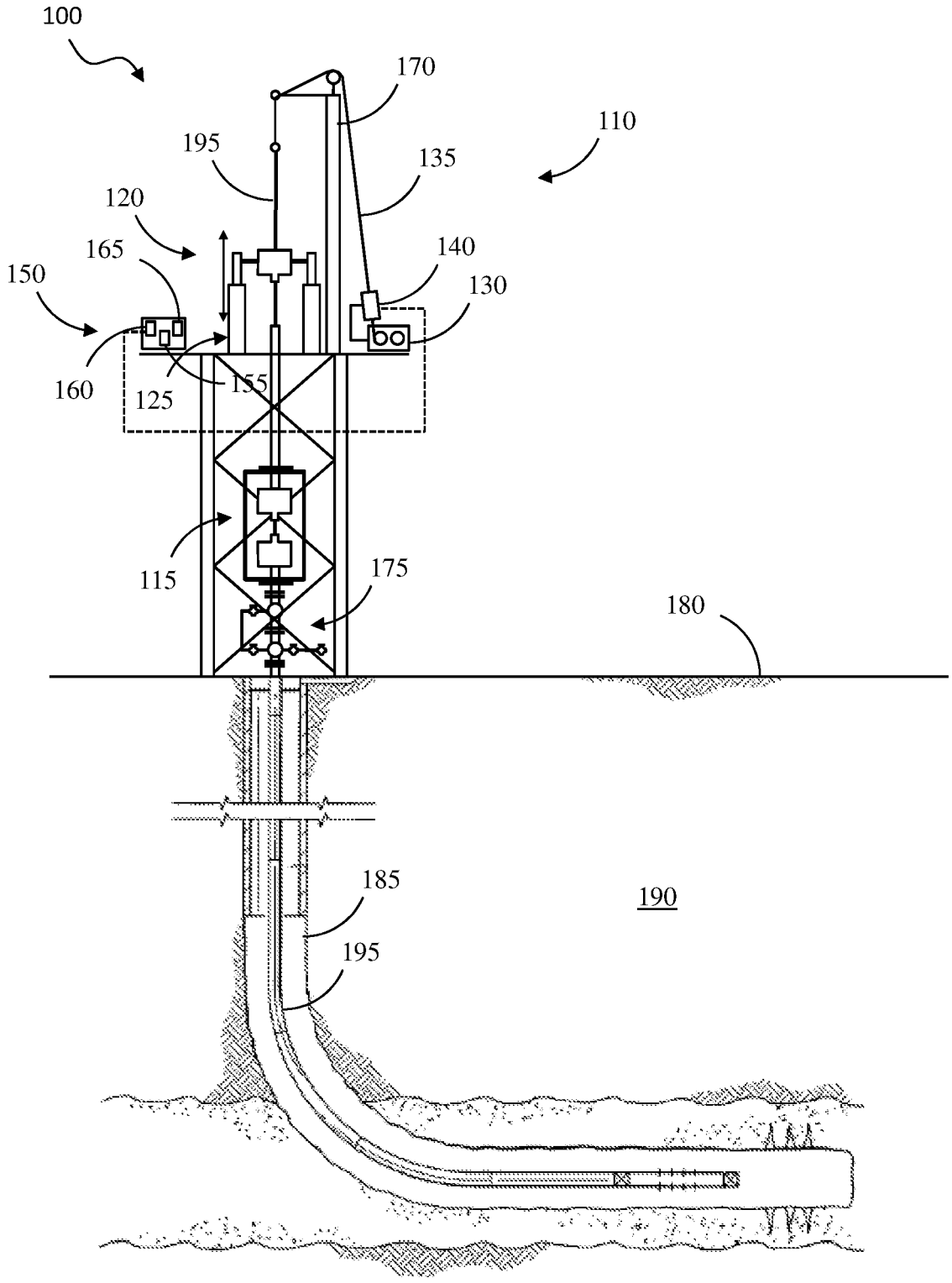
Figure 2:
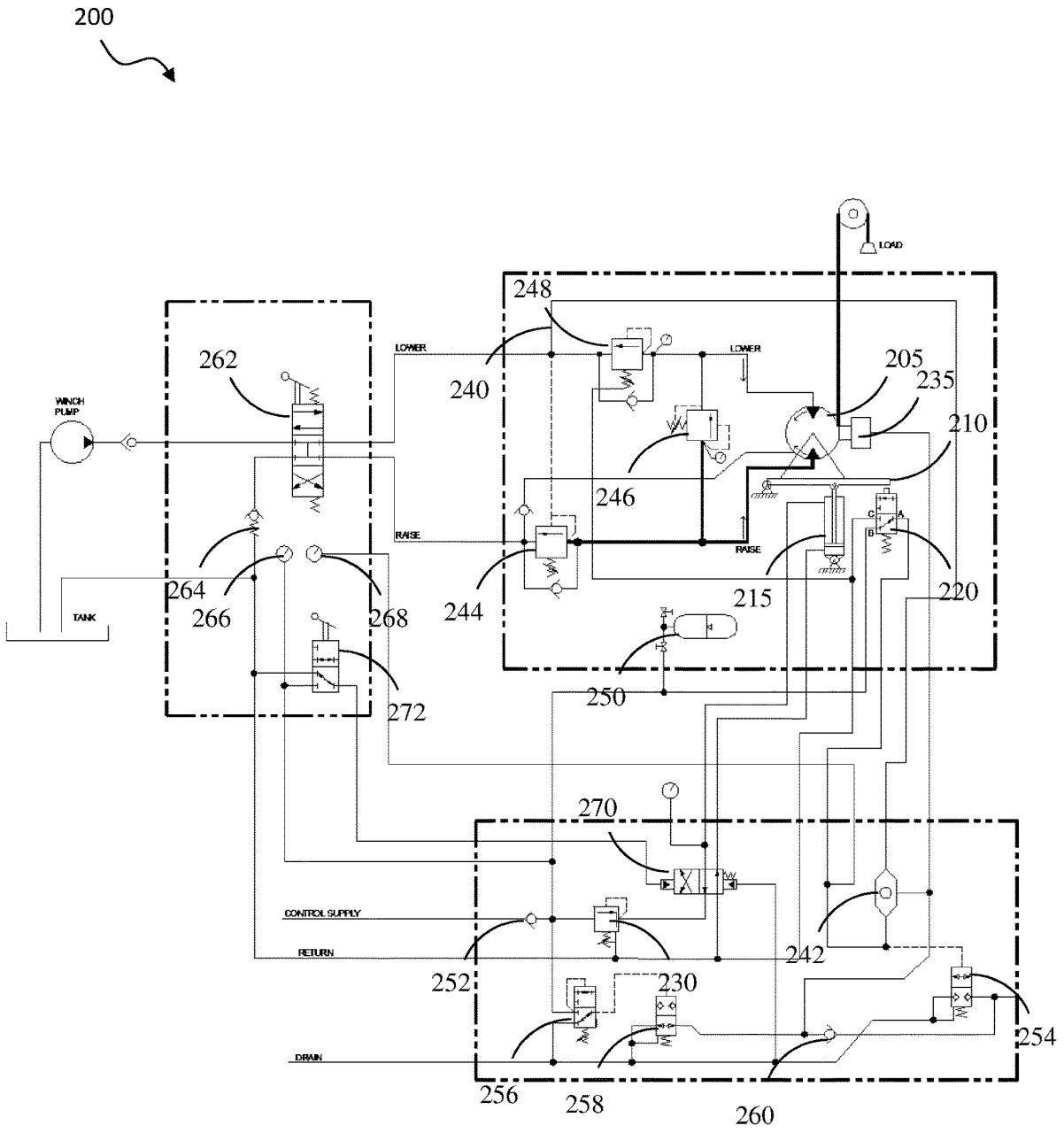

Reference is now made to the following descriptions taken in conjunction with the accompanying drawings, in which:

FIG. 1 is an elevation view of an example workover system according to aspects of the present disclosure; and FIG. 2 is an operational diagram of an alternative embodiment of a winch overload protection system in accordance with the disclosure.

DETAILED DESCRIPTION

The present disclosure is directed, in part, to helping ensure that the travelling slip and winch of a Hydraulic Workover Unit (HWO) are sufficiently synchronized (i.e. "in sync"). Specifically, aspects of the present disclosure include avoiding situations when the travelling slip is operational, and moving, when the winch is inoperable, and more particularly when the brake of the winch is set.

In one aspect, a winch overload protection system is provided for use with the HWO. For example, a winch overload protection system may include an overload detection unit and overload control unit. In one implementation, the overload detection unit may be configured to detect when a load on the winch exceeds a safety load limit, and the overload control unit may be configured to receive an overload signal from the overload detection unit. In response, a brake on the winch may be released.

Reference will now be made to the drawings wherein like reference numerals identify similar structural features or aspects of the subject disclosure. For purposes of explanation and illustration, and not limitation, FIG. 1 illustrates an elevation view of an example workover system 100 according to aspects of the present disclosure. The workover system 100 includes a rig 110 (e.g., an HWO in the illustrated embodiment) mounted at the surface 180 and positioned above wellbore 185 within a subterranean formation 190. In the embodiment shown, a downhole tool or pipe 195 is to be positioned within the wellbore 185 and may be coupled to the rig 110, as shown.

In accordance with the disclosure, the rig 110, illustrated as a HWO, includes a stationary slip 115 and a travelling slip 120. As those skilled in the art appreciate, the travelling slip 120, in the embodiment shown, may be coupled to one or more jack cylinders 125 (e.g., hydraulic jack cylinders in one embodiment) that are configured to cycle the travelling slip 120 in a linear path relative to the stationary slip 115. In this deployment, the stationary slip 115 and travelling slip 120 can work together to collectively insert or remove various different types of downhole tools or pipes 195 in the wellbore 185.

The rig 100, in the embodiment shown, further includes a winch 130, having a cable 135 (e.g., any known or hereafter discovered wire, rope, etc.) associated therewith. In accordance with the disclosure, the winch 130 additionally includes a brake 140 associated therewith. The brake 140, as those skilled in the art appreciate, is designed to stop the cable 135, and thus the downhole tools or pipes 195 coupled thereto, from moving under certain circumstances. The brake 140 may comprise a mechanical, electrical, or hydraulic brake, among others, and remain with the scope of the disclosure.

The workover system 100, in accordance with the disclosure, further includes a winch overload protection system 150 associated with the rig 110. In the embodiment shown, the winch overload protection system 150 includes an overload detection unit 155. The overload detection unit 155, in this embodiment, is operable to detect when a load on the winch 130 exceeds a safety load limit. The safety load limit may be a fixed value, or alternatively, a customizable value. For example, the safety load limit could be tailored based upon the design of the rig 110, the winch 130, the downhole tools or pipes 195 being deployed, as well as other relevant factors. In one embodiment, the value of the safety load limit is chosen such that it will be triggered prior to the other relevant features failing.

The overload protection system 150, in accordance with the disclosure, further includes an overload control unit 160. The overload control unit 160, in the illustrated embodiment, is configured to receive an overload signal from the overload detection unit 155, and in response thereto release the brake 140 on the winch 130. In doing so, the overload control unit 160 attempts to eliminate any damage that may result with the workover system 100 as a result of the winch exceeding the safety load limit.

In one embodiment, the overload control unit 160, or the brake 140, must be actively reset prior to the workover system 100 being used again. In yet another embodiment, the overload control unit 160 may independently reset itself, for example automatically without human involvement. Another embodiment exists wherein the overload control unit 160 reengages the brake 140 on the winch 130 when the load on the winch 130 no longer exceeds the safety load limit.

A possible condition can exist where the traveling slip 120 is still operational while the brake 140 is engaged, thereby creating an overload condition. Accordingly, the overload control unit 160 may additionally be configured to stop a movement of the travelling slip 120 in response to receiving the overload signal from the overload detection unit 155. By releasing the brake 140, and stopping a movement of the travelling slip 120, the workover system 100 is materially protected from a winch 130 overload situation.

In accordance with the disclosure, the overload control unit 160 may further be configured to maintain back pressure on the winch 130 upon the release of the brake 140. The back pressure, in this embodiment, is designed to maintain at least some tension on the cable 135, such that it does not spool off uncontrollably when the brake 140 is released.

The winch overload protection system 150 may further include a test unit 165. The test unit 165, in one embodiment, is configured to intentionally simulate an overload situation, thus artificially creating the overload signal to thereby test the winch overload protection system. The test unit 165, in this embodiment, may be deployed to periodically test the readiness and reliability of the winch overload protection system 150.

The rig 110 illustrated in FIG. 1 further includes a mast pole 170. While the embodiment shown illustrates the mast pole 170 as stationary, other embodiments exist wherein the mast pole 170 telescopes to various different heights, for example to handle different lengths of downhole tools or pipes 195 being deployed. The rig 110 may further include a blowout preventer stack 175. In the illustrated embodiment, the blowout preventer stack 175 is positioned in-line between the stationary slip 115 and the surface 180. Those skilled in the art appreciate the purpose and location of the blowout preventer stack 175, as well as the many different designs it may take.

The workover system 100 may additionally include any suitable wired drillpipe, coiled tubing (wired and unwired), e.g., accommodating a wireline for control of the system from the surface 180 during downhole operation. It is also contemplated that the workover system 100 as described herein can be used in conjunction with a measurement-while-drilling (MWD) apparatus, which may be incorporated into the downhole tool or pipe 195 for insertion in the wellbore 185 as part of a MWD system. In a MWD system, sensors associated with the MWD apparatus provide data to the MWD apparatus for communicating up the downhole tool or pipe 195 to an operator of the workover system 100. These sensors typically provide directional information of the downhole tool or pipe 195 so that the operator can monitor the orientation of the downhole tool or pipe 195 in response to data received from the MWD apparatus and adjust the orientation of the downhole tool or pipe 195 in response to such data. An MWD system also typically enables the communication of data from the operator of the system down the wellbore 185 to the MWD apparatus. Systems and methods as disclosed herein can also be used in conjunction with logging-while-drilling (LWD) systems, which log data from sensors similar to those used in MWD systems as described herein.

The workover system 100 of FIG. 1 may be used to trip a workover system, and more particularly downhole tools or pipe, into or out of a wellbore. In accordance with the disclosure, as the hydraulic workover unit trips the downhole tool or pipe into or out of the wellbore, the winch overload protection system is detecting for winch overload situations. When the winch overload protection system detects when a load on the winch exceeds the safety load limit, it sends an overload signal to the overload control unit. In accordance with the disclosure, when the overload control unit receives the overload signal, it releases the brake on the winch.

Turning to FIG. 2, illustrated is an operational diagram of an alternative embodiment of a winch overload protection system 200 in accordance with the disclosure. The winch overload protection system 200 illustrated in FIG. 2 primarily operates using hydraulics, thus may represent a hydraulic circuit. As shown in FIG. 2, winch 205 is supported by frame 210 which is connected to a cylinder 215 that acts as the pre-loaded force (e.g., anti-pivot) device. Frame 210 is pivotally connected to an essentially fixed point at one end, and to cylinder 215 and movement sensor 220 at the other. Frame 210 is thus a pivotable frame. Similarly the cylinder 215 is pivotally connected to an essentially fixed point at its bottom end, and movement sensor 220 is fixed in proximity to frame 210. This arrangement is such that vertical force on the winch cable tends to lift and pivot frame 210 and thereby extend cylinder 215 and also lift the frame off of movement sensor 220.

In the embodiment shown, cylinder 215 is supplied with a constant pressure to its rod end via pressure reducing/relieving valve 230, which tends to hold the cylinder 215 fully retracted with a force proportional to the supply pressure. As long as the supply pressure from valve 230 times the area of the rod end of cylinder 215, adjusted for mechanical advantage, is greater than the maximum allowable cable tension, then frame 210 will be held against movement sensor 220 such that its plunger is depressed. In the embodiment of FIG. 2, movement sensor 220 is dispositioned such that it does not activate the overload protection system as long as its plunger is held down.

If and when the winch cable is pulled with a force that exceeds hydraulic pre-load of cylinder 215, then pressure reducing/relieving valve 230 will vent the overpressure on the rod end of the cylinder 215 back to the hydraulic reservoir, allowing cylinder 215 to extend. Subsequently frame 210 will rise as it rotates about its pivot point and lift off of movement sensor 220 activating the overload protection system. In this manner the pressure from valve 230 applied to the rod end of the cylinder, combined with the physical geometry of the mechanism can be used to calculate and/or pre-set the maximum operating force on the winch cable, above which the overload system activates.

In the embodiment of FIG. 2, the winch brake 235 is normally engaged by internal springs and released by pressure tapped from the operator's winch control valve 262 via line 240 when lowering a load and cable is pulled off the winch 205. When the operator centers control valve 262 the brake line 240 is vented, which engages the brake 235 via the internal springs. This ensures that the load will not fall when no winch 205 movement is commanded by the operator. Shuttle valve 242 is provided so that the brake can be operated either by the normal operator control or by the overload protection control system. When the overload system is activated by movement of frame 210, it triggers movement sensor 220, then movement sensor 220 directs hydraulic pressure from the supply source through shuttle 242 to release brake 235 preventing further overload.

In the embodiment of FIG. 2, valve 244 is a motor control or counterbalance valve that is typically present in winch 205 hydraulic systems to allow controlled descent of a load. Valve 246 is a relief type valve that is interposed between the winch 205 and valve 244. Its purpose is to maintain back pressure to the winch 205 once the overload is triggered, keeping a safe amount of tension on the winch cable to prevent uncontrolled release of the cable. Because valve 246 is between the winch 205 and the motor control valve 244, all of the lines shown as heavy solid lines in FIG. 2 should typically be hard plumbed rather than by use of hoses. This is to reduce the risk that breakage in the intervening lines will allow the load to fall uncontrolled. Once the overload protection system is triggered, valve 246 recirculates oil around the motor, but at a controlled pressure. Typically, valve 246 is set so that it opens at a load that is slightly higher than the overload setting of the brake. In the embodiment of FIG. 2, valve 248 is a low pressure relief valve that is provided to avoid loss of the recirculated oil (when overload is triggered) to prevent possible cavitation of the winch motor, which could result in loss of load control.

Valve 230, as described in the embodiment above, is essentially the overload setting control to pre-set the amount of force needed to trigger the overload protection system. It is supplied directly via a constant hydraulic supply pressure that should be higher than that demanded by valve 230 to set the overload force. Accumulator 250 can be used to provide backup pressure in case the normal supply pressure fails. Check valve 252 ensures that accumulator 250 stays charged once brought up to pressure.

In the system depicted in FIG. 2, two interlocks are included to enhance the overall safety of operation of this system. Jack interrupt valve 254 provides a "vent" type signal once the overload protection is triggered. Normally this would be used to cause the HWO unit's traveling slip to stop once an overload is detected. Since the normal source of any such winch overload is the HWO unit's travelling slip moving downwards, stopping the travelling slip provides additional safety. The second interlock is provided by valves 256 and 258. Valve 258 is normally set to "vent" both the brake 235 and the HWO Jack interlock. It is shifted to "closed" when valve 256 is supplied with the minimum required system supply pressure. With this arrangement, neither the travelling slip nor the winch 205 can be operated unless the overload protection system has adequate pressure to arm the system. Check valve 260 is present to isolate the supply pressure interlock from the normal jack interrupt function upon overload.

In the embodiment of FIG. 2, the main operator control for the winch 205 is valve 262. The operator uses this valve to raise and lower loads with the winch, with brake control provided automatically by sense of line 240 through shuttle valve 242. Spring-biased check valve 264 can be installed on the return line of the operator's control valve to prevent drainage of fluid out of the winch 205 power lines and thereby help reduce risk of winch motor cavitation. Two pressure gauges can be installed in the operator console that display the system supply pressure 266, and to show if the winch brake is being operated by the overload protection system 268.

A self-test feature can also be provided via remotely operated valve 270 and by operator control valve 272. When valve 272 is shifted it also shifts valve 270 to reverse the pressure to cylinder 215. This causes the cylinder to extend and lift frame 210 and winch 205. This immediately demonstrates that frame 210 is free to move, and that adequate system pressure is available on gauge 266. Movement of the winch and frame 210 triggers the overload system to apply pressure to the brake causing it to release, which can be verified on pressure gauge 268. With this arrangement the readiness and operation of the overload protection system can be fully tested at any time as long as there is no load on the winch. The system as depicted will automatically disengage the winch brake upon overload of the winch, and also automatically reset once the overload condition is removed from the winch. This has the advantage of not requiring any operator intervention for normal overload protection system operation.

FIG. 2 has illustrated but one embodiment of a winch overload protection system 200. In fact, a winch overload protection system manufactured according to the disclosure may vary greatly from that depicted in FIG. 2. For example, cylinder 215 can be replaced by a spring that has been preloaded to the required overload force setting. Additionally, some or all of the hydraulic overload controls can be replaced with electrical devices that have similar functions. Along those lines, some or all of the hydraulic overload controls can be operated via electrical solenoids and switches rather than pilot pressure.

In alternative embodiments, movement sensor 220 can be replaced with an electrical or electronic switch to operate any or all electrical controls. Additionally, accumulator 250 can be replaced with a battery backup device to operate any or all electrical controls, or be replaced with an active redundant hydraulic or electrical supply. Moreover, the system can be designed and operated without the self-test function, eliminating valves 270 and 272.

In yet alternative embodiments, this system can be designed and operated without valves 248 and/or 264, but with increased operational risk. Moreover, frame 210, shown as a pivoting beam or plate, can be replaced with beam(s) and/or plate(s) that are mobilized with pins, hinges, rollers, tracks, slides, etc., such that the frame 210 moves substantially in the direction of the winch cable when a force is applied by the cable. Additionally, pressure gauges can be installed in line with any of the adjustable valves to facilitate setting of those valves.

In even alternative embodiments, the system can be designed and operated without the HWO Jack interrupt feature. Moreover, the hydraulic and/or electrical controls can be grouped in module(s) or manifold(s) to consolidate components.

While the above system has been discussed for use with HWO operations, the present disclosure should not be limited to such. For example, a winch overload protection system as discussed herein can be installed on or with most any winch to provide overload protection in many applications, and remain within the purview of the disclosure.

Embodiments disclosed herein include:

A. A winch overload protection system, comprising an overload detection unit operable to detect when a load on a winch of a workover system exceeds a safety load limit, and an overload control unit configured to receive an overload signal from the overload detection unit, and in response thereto release a brake on the winch.

B. A workover system, comprising a hydraulic workover unit elevated over a wellbore. The hydraulic workover unit, in this instance including a stationary slip, a travelling slip coupled to one or more hydraulic jack cylinders, the one or more hydraulic jack cylinders configured to cycle the travelling slip in a linear path relative to the stationary slip, and a winch having a cable and brake associated therewith, the winch configured to provide downhole tools and or pipe to the travelling slip for inclusion within or removal from the wellbore. The workover system, in this instance, may additionally comprise a winch overload protection system associated with the hydraulic workover unit, the winch overload system including an overload detection unit operable to detect when a load on the winch exceeds a safety load limit, and an overload control unit configured to receive an overload signal from the overload detection unit, and in response thereto release the brake on the winch.

C. A method of operating a workover system, comprising, tripping downhole tools and or pipe into or out of a wellbore using a workover system, wherein the workover system includes a hydraulic workover unit elevated over the wellbore, the hydraulic workover unit including a stationary slip, a travelling slip coupled to one or more hydraulic jack cylinders, the one or more hydraulic cylinders configured to cycle the travelling slip in a linear path relative to the stationary slip, and a winch having a cable and brake associated therewith, the winch configured to provide the downhole tools and or pipe to the travelling slip for inclusion within the wellbore. The method, in this instance, further comprises detecting winch overload situations during the tripping using a winch overload protection system associated with the hydraulic workover unit, the winch overload system including an overload detection unit operable to detect when a load on the winch exceeds a safety load limit, and an overload control unit configured to receive an overload signal from the overload detection unit, and in response thereto release the brake on the winch.

Each of the embodiments A, B and C may have one or more of the following additional elements in combination:

Element 1: wherein the overload control unit is further configured to stop the movement of an associated travelling slip of a hydraulic workover unit in response to receiving the overload signal. Element 2: wherein the overload control unit is configured to maintain back pressure on the winch to maintain a safe amount of tension in a cable thereof when the brake is released. Element 3: wherein the overload control unit is configured to reengage the brake on the winch when the load on the winch no longer exceeds the safety load limit. Element 4: wherein the overload control unit is configured to reengage the brake automatically without human involvement. Element 5: wherein the overload detection unit includes a pivotable frame for supporting the winch, a pre-loaded anti pivot device coupled to the frame, the pre-loaded anti pivot device configured to hold the frame in a substantially fixed position until the winch exceeds the safety load limit, and a movement sensor for detecting movement of the frame when the winch exceeds the safety load limit. Element 6: wherein the pre-loaded anti pivot device is a hydraulic cylinder and the movement sensor is a hydraulic or an electronic switch. Element 7: further including a test unit, the test unit configured to intentionally extend the hydraulic cylinder to artificially create the overload signal to thereby test the winch overload protection system. Element 8: wherein the pre-loaded anti pivot device is a mechanical spring. Element 9: wherein the overload detection unit and the overload control unit employ a hydraulic circuit to detect when the winch exceeds the safety load limit and release the brake on the winch. Element 10: wherein the movement sensor is a hydraulic switch. Element 11: wherein the movement sensor is an electronic switch. Element 12: further including a test unit, the test unit configured to intentionally extend the hydraulic cylinder to artificially create the overload signal to thereby test the winch overload protection system.

Those skilled in the art to which this application relates will appreciate that other and further additions, deletions, substitutions and modifications may be made to the described embodiments.

What is claimed is:

1. A winch overload protection system, comprising:

an overload detection unit operable to detect when a load on a winch of a workover system exceeds a safety load limit; and an overload control unit configured to receive an overload signal from the overload detection unit, and in response thereto disengage a brake on the winch, wherein the overload detection unit includes a pivotable frame for supporting the winch, a pre-loaded anti pivot device coupled to the frame, the pre-loaded anti pivot device configured to hold the frame in a substantially fixed position until the winch exceeds the safety load limit, and a movement sensor for detecting movement of the frame when the winch exceeds the safety load limit.

2. The winch overload protection system as recited in claim 1, wherein the overload control unit stops a movement of an associated travelling slip of a hydraulic workover unit in response to receiving the overload signal.

3. The winch overload protection system as recited in claim 1, wherein the overload control unit is configured to maintain back pressure on the winch to maintain tension in a cable thereof when the brake is disengaged.

4. The winch overload protection system as recited in claim 1, wherein the overload control unit reengages the brake on the winch when the load on the winch no longer exceeds the safety load limit.

5. The winch overload protection system as recited in claim 4, wherein the overload control unit reengages the brake automatically without human involvement.

6. The winch overload protection system as recited in claim 1, wherein the pre-loaded anti pivot device is a hydraulic cylinder and the movement sensor is a hydraulic or an electronic switch.

7. The winch overload protection system as recited in claim 6, further including a test unit, the test unit configured to intentionally extend the hydraulic cylinder to artificially create the overload signal to thereby test the winch overload protection system.

8. The winch overload protection system as recited in claim 1, wherein the pre-loaded anti pivot device is a mechanical spring.

9. The winch overload protection system as recited in claim 1, wherein the overload detection unit and the overload control unit employ a hydraulic circuit to detect when the winch exceeds the safety load limit and disengage the brake on the winch.

10. A workover system, comprising:

a hydraulic workover unit elevated over a wellbore, the hydraulic workover unit including:

a stationary slip;

a travelling slip coupled to one or more hydraulic jack cylinders, the one or more hydraulic jack cylinders configured to cycle the travelling slip in a linear path relative to the stationary slip; and a winch having a cable and brake associated therewith, the winch configured to provide downhole tools and or pipe to the travelling slip for inclusion within or removal from the wellbore; and a winch overload protection system associated with the hydraulic workover unit, the winch overload system including:

an overload detection unit operable to detect when a load on the winch exceeds a safety load limit; and an overload control unit configured to receive an overload signal from the overload detection unit, and in response thereto disengage the brake on the winch.

11. The workover system as recited in claim 10, wherein the overload control unit is further configured to stop a movement of the travelling slip in response to receiving the overload signal.

12. The workover system as recited in claim 10, wherein the overload control unit is configured to maintain back pressure on the winch to maintain a safe amount of tension in the cable when the brake is disengaged.

13. The workover system as recited in claim 10, wherein the overload control unit is configured to reengage the brake on the winch when the load on the winch no longer exceeds the safety load limit.

14. The workover system as recited in claim 10, wherein the overload detection unit includes a pivotable frame for supporting the winch, a pre-loaded anti pivot device coupled to a bottom side of the frame, the pre-loaded anti pivot device configured to hold the frame in a substantially fixed position until the winch exceeds the safety load limit, and a movement sensor for detecting movement of the frame when the winch exceeds the safety load limit.

15. The workover system as recited in claim 14, wherein the pre-loaded anti pivot device is a hydraulic cylinder or a mechanical spring, and further wherein the movement sensor is a hydraulic switch or an electronic switch.

16. The workover system as recited in claim 15, further including a test unit, the test unit configured to intentionally extend the hydraulic cylinder to artificially create the overload signal to thereby test the winch overload protection system.

17. The workover system as recited in claim 10, wherein the overload detection unit and the overload control unit employ a hydraulic circuit to detect when the winch exceeds the safety load limit and disengage the brake on the winch.

18. The workover system as recited in claim 10, further including a blowout preventer stack.

19. A method of operating a workover system, comprising:

tripping downhole tools and or pipe into or out of a wellbore using a workover system, wherein the workover system includes;

a hydraulic workover unit elevated over the wellbore, the hydraulic workover unit including:

a stationary slip;

a travelling slip coupled to one or more hydraulic jack cylinders, the one or more hydraulic cylinders configured to cycle the travelling slip in a linear path relative to the stationary slip; and a winch having a cable and brake associated therewith, the winch configured to provide the downhole tools and or pipe to the travelling slip for inclusion within the wellbore; and detecting winch overload situations during the tripping using a winch overload protection system associated with the hydraulic workover unit, the winch overload system including:

an overload detection unit operable to detect when a load on the winch exceeds a safety load limit; and an overload control unit configured to receive an overload signal from the overload detection unit, and in response thereto disengage the brake on the winch.

* * * * *